US011103894B2

(12) United States Patent
Azzolin et al.

(10) Patent No.: US 11,103,894 B2
(45) Date of Patent: Aug. 31, 2021

(54) SCREENING BUCKET

(71) Applicant: MECCANICA BREGANZESE S.P.A. in breve MB S.P.A., Fara Vicentino (IT)

(72) Inventors: Guido Azzolin, Breganze (IT); Diego Azzolin, Breganze (IT)

(73) Assignee: MECCANICA BREGANZESE S.P.A. IN BREVE MB S.P.A., Fara Vicentino (IT)

( * ) Notice: Subject to any disclaimer, the term of this patent is extended or adjusted under 35 U.S.C. 154(b) by 121 days.

(21) Appl. No.: 16/629,741

(22) PCT Filed: Jul. 11, 2018

(86) PCT No.: PCT/IB2018/055111
§ 371 (c)(1),
(2) Date: Jan. 9, 2020

(87) PCT Pub. No.: WO2019/012446
PCT Pub. Date: Jan. 17, 2019

(65) Prior Publication Data

US 2020/0171545 A1 Jun. 4, 2020

(30) Foreign Application Priority Data

Jul. 11, 2017 (IT) ..... 102017000078145

(51) Int. Cl.
*E02F 7/06* (2006.01)
*B07B 1/00* (2006.01)
*B07B 1/15* (2006.01)

(52) U.S. Cl.
CPC ..... *B07B 1/005* (2013.01); *B07B 1/155* (2013.01); *E02F 7/06* (2013.01)

(58) Field of Classification Search
CPC ..... E02F 7/00; E02F 7/06; E02F 3/40; B07B 1/155; B07B 1/005
(Continued)

(56) References Cited

U.S. PATENT DOCUMENTS 3,732,980 A * 5/1973 Evers ..... E02F 3/401 209/421
4,082,232 A 4/1978 Brewer
(Continued)

FOREIGN PATENT DOCUMENTS

EP 2204501 A1 * 7/2010 ..... E02F 3/407
EP 2204501 A1 7/2010
(Continued)

OTHER PUBLICATIONS

Zalud T: "Spherical Roller Bearings Made to Shake, Rattle, and Roll", Machine Design, Penton Media, Cleveland, OH, US, vol. 71, No. 23. Dec. 9, 1999 (Dec. 9, 1999), p. 43, XP001141927, ISSN: 0024-9114.

*Primary Examiner* — Terrell H Matthews
(74) *Attorney, Agent, or Firm* — Volpe Koenig

(57) ABSTRACT

A screening bucket comprises a main structure which includes a collecting portion for the material to be screened and a receiving member in which there is collected the material which is subjected to sieving and which has a discharge opening for the screened material. A plurality of rotating elements are arranged in the region of the discharge opening and are supported in a removable manner on pairs of opposing bearing groups. The bearing groups comprise a bearing and a rotatable support, to which there is connected an end of the rotating element by means of a male/female connection, wherein the rotatable support further comprises a locking portion which is capable of being retained by means of a corresponding retention device so as to prevent
(Continued)

the rotation of the rotatable support when the rotating element is removed.

20 Claims, 6 Drawing Sheets

(58) Field of Classification Search
USPC ..... 209/420
See application file for complete search history.

(56) References Cited

U.S. PATENT DOCUMENTS 4,157,956 A * 6/1979 Robinson ..... B07B 1/10 209/260
5,002,656 A * 3/1991 Johansson ..... E02F 3/401 209/421
5,592,760 A 1/1997 Kohout
6,237,865 B1 * 5/2001 Luttermann ..... B02C 13/2804 241/101.72
2004/0050562 A1 3/2004 Stevens
2011/0297772 A1 12/2011 Pan
2014/0079520 A1 3/2014 Kent
2014/0326816 A1 * 11/2014 Azzolin ..... E02F 3/407 241/81
2016/0177537 A1 6/2016 Krell et al.

FOREIGN PATENT DOCUMENTS

EP 2 990 541 A1 3/2016
FR 2 663 383 A1 12/1991
JP H0988354 A 3/1997
JP 2004 285717 A 10/2004
KR 100 769 089 B1 10/2007
WO 2017 068237 A1 4/2017

* cited by examiner

Fig. 1
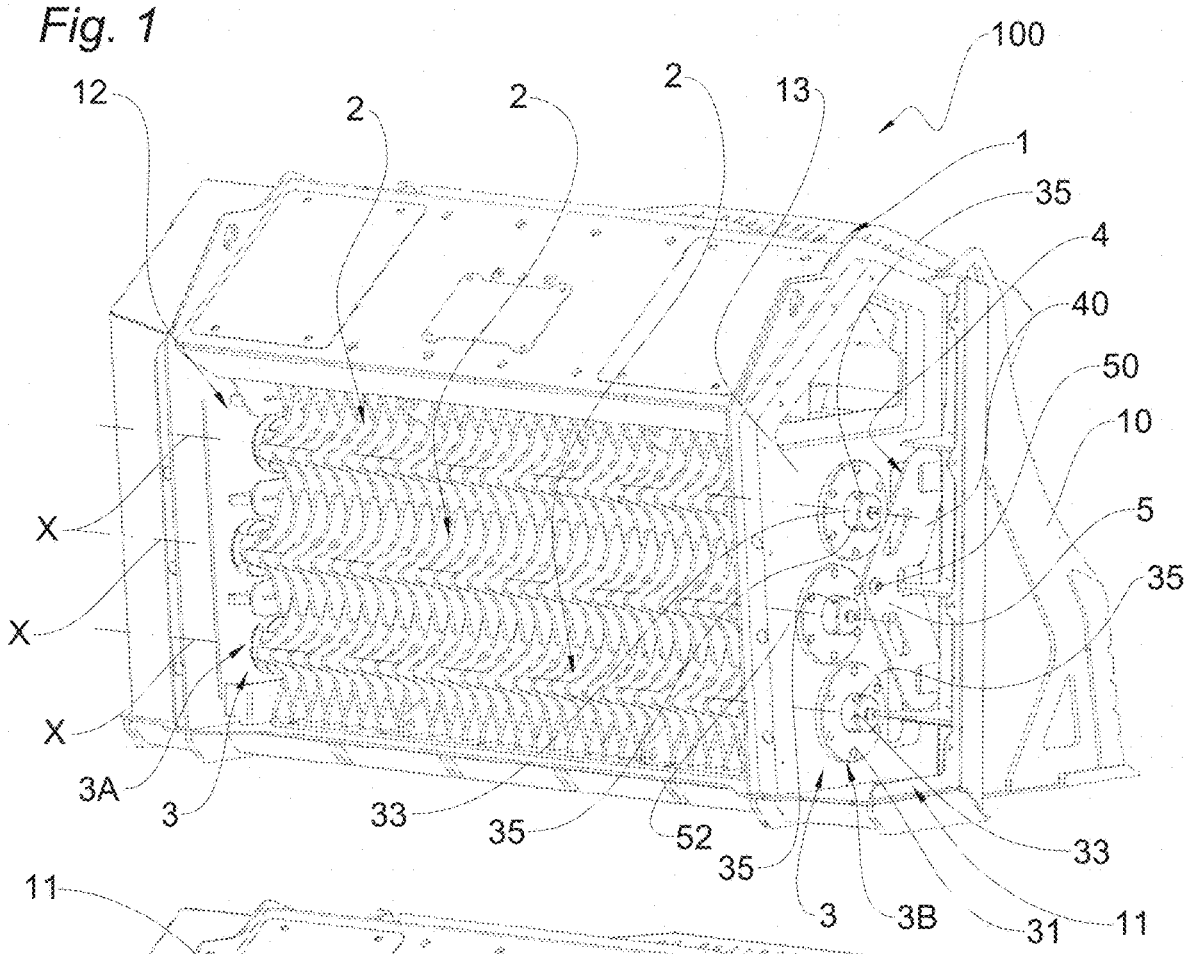
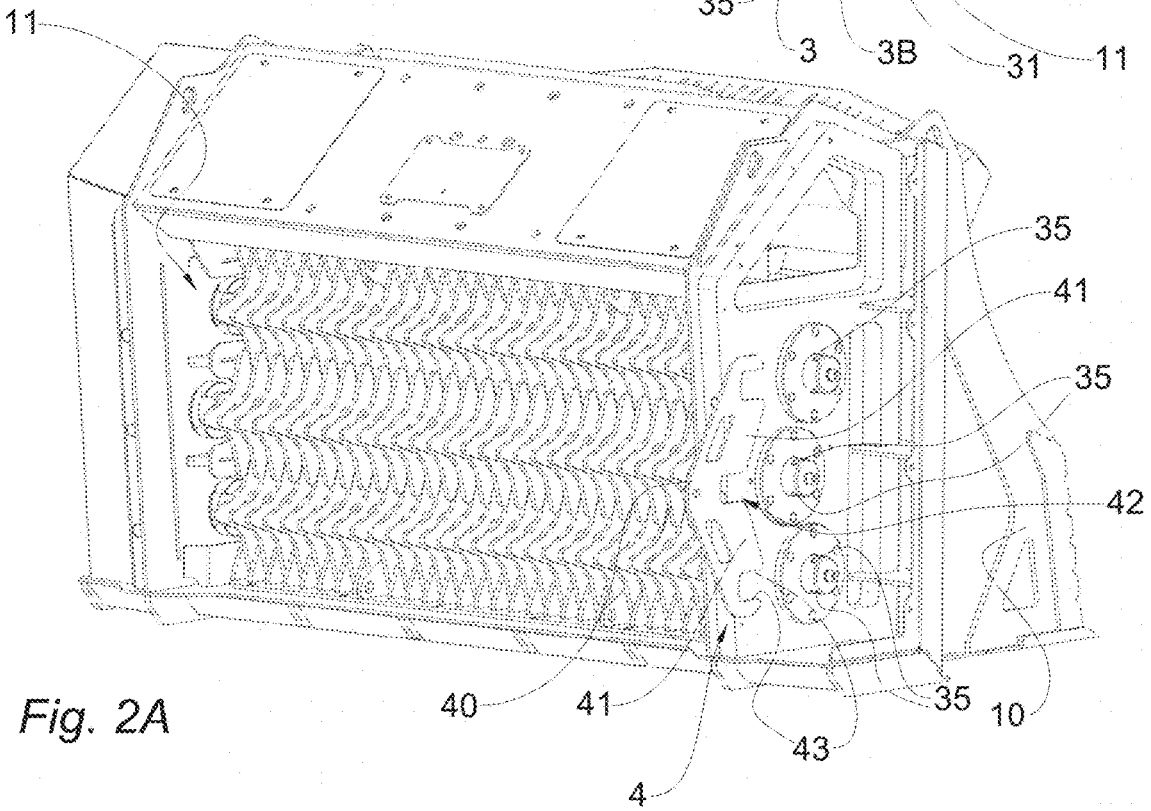
Fig. 2A

SCREENING BUCKET

The present invention relates to a screening bucket of the type comprising a plurality of rotating elements which are arranged parallel with each other.

In the technical field being referred to, there are known buckets which can be applied to the end of the arm of an operating machine and which are intended for collecting inert materials, such as materials resulting from demolished buildings, and which are provided with a screening system which allows the removal of rubble with small dimensions collected thereby.

An example of such buckets is described in the patent application EP2204501, in which there is used a screening system which is formed by a pair of rotating rollers.

The rollers have a plurality of radial extensions which act on the material during the rotation thereof.

Since they are intended for a particularly heavy processing operation from the mechanical point of view, there may be provision for the possibility of removing the rollers for the replacement thereof or for subjecting them to maintenance. Furthermore, the replacement of the rollers can also be provided in accordance with the processing and the type of material which is subjected to screening which could require rollers of a different type.

To this end, the patent application cited above provides for the use of the receiving seats of the rollers and the relevant bearing which are formed by lateral walls of the bucket comprising two separate portions.

In particular, one of the two portions can be removed so as to leave open the seat and to allow the insertion and removal of the shaft.

However, this solution is not found to be practical if it is necessary to change the type of the rollers because there is provision not only for the replacement of the roller but also of the bearings which support it.

A similar solution is also described in JP H09 88354.

Another problem associated with the known solutions is connected with the use of the radial extensions in the rollers which, in order to operate correctly, have to be in phase with the extensions of the adjacent rollers.

During the assembly steps of the rollers, however, it may be complex to arrange the rollers in a correct angular position. This problem is further particularly perceived in the solutions in which the rollers can be detached from the bearings in which, however, the bearing remains fixed to the structure of the bucket even when the rollers are removed.

It is evident that, during the subsequent re-assembly of the rollers, the bearings with the relevant supports for the rollers could have performed rotations with respect to the last angular positions thereof, thereby losing the original phasing.

This inevitably involves difficulties of assembly both in terms of complexity and in terms of time required.

Therefore, the technical problem addressed by the present invention is to provide a screening bucket which allows one or more of the disadvantages mentioned above with reference to the prior art to be at least partially overcome.

In the context of this problem, an object of the present invention is to provide a screening bucket in which the screening rollers can be replaced simply while keeping the bearings and the relevant supports fixed to the main structure of the bucket itself.

Another object is to provide a screening bucket comprising a plurality of replaceable rollers in which the supports for the rollers maintain the mutual phasing even when the rollers are removed.

This problem is solved by a screening bucket comprising a main structure which includes a collecting portion for the material to be screened and a receiving member in which there is collected the material which is subjected to sieving and which has a discharge opening for the screened material, a plurality of rotating elements which are arranged in the region of the discharge opening so as to at least partially obstruct the discharge opening, allowing the passage of material having dimensions less than a predetermined dimension when the rotating elements are rotated, the rotating elements being supported in a removable manner on pairs of opposing bearing groups. The bearing groups comprise a bearing and a rotatable support which is fixed to the bearing and to which there is connected an end of the rotating element by a male/female connection which is formed by a receiving seat and by a coupling extension formed on the rotatable support and on the rotating element, respectively, or vice-versa. The receiving seat and the coupling extension are configured so that the coupling extension can be inserted in/withdrawn from the receiving seat by of a reciprocal movement towards/away in a transverse direction with respect to the rotation axis of the rotation element. The rotatable support further comprises a locking portion which is capable of being retained by a corresponding retention device so as to prevent the rotation of the rotatable support when the rotating element is removed.

The screening bucket according to the present invention allows the assembly and optional replacement of the rotating elements in a simple and rapid manner.

In fact, the use of a male and female connection between rotating elements and rotatable supports makes it possible to join those elements by a simple form-fitting connection.

Furthermore, since the insertion/withdrawal of the coupling extension in/from the receiving seat can be carried out by means of a transverse movement with respect to the rotation axis of the rotating element, the removal thereof can be carried out without disassembling the bearing, it instead being possible to remove the rotating element from the rotatable support.

As a result of the use of a retention device, it is thus possible to lock the rotatable supports in the most advantageous position in order to receive the relevant rotating elements.

At the same time, the retention device allows prevention of the rotation of the rotatable supports when the rotating elements are removed, thereby allowing the angular phasing to be maintained.

Preferably, the receiving seat has a base wall which is configured so as to abut the coupling extension when it is inserted in the receiving seat in an insertion direction, blocking the advance thereof in the insertion direction. In this manner, the rotating element can be supported when it is assembled, thereby making these operations easier even in light of the weight which these elements typically have.

According to a preferred embodiment, the receiving seat and/or the shaped portion has/have a tapered shape. This allows the rotating element to be advantageously guided in the receiving seat.

Preferably, the receiving seat and/or the shaped portion is/are tapered in the insertion direction, thereby also promoting centering with respect to the rotation axis.

According to another aspect, the locking portions comprise a planar surface which allows definition of a form-fitting connection which is simple but at the same time effective in terms of preventing the rotation. More preferably, there are provided a pair of diametrically opposed planar surfaces in order to further increase the stability of the connection and to make the positioning of the retention device even simpler.

In one embodiment, the bearing groups are supported on a respective lateral wall of the receiving member. Preferably, the locking portions project from the lateral walls in the opposite direction with respect to the rotating elements and, even more preferably, with respect to the rotatable supports. This configuration allows optimization of the accessibility of the locking portions by the retention device.

According to another aspect, the invention also relates to a retention device for rotatable supports of a screening bucket which is produced according to one or more of the preceding characteristics mentioned, comprising a plurality of shaped elements which are configured so as to be able to be connected to the locking portions so as to prevent the rotation of the rotatable supports.

On the basis of this aspect, it is also advantageously possible to retain the rotatable supports of the rotating elements, achieving the advantages mentioned above.

Preferably, the retention device comprises a plate, thereby ensuring a simple and economical construction thereof.

According to a preferred embodiment, there are defined in the retention device blocking recesses between adjacent shaped elements, inside which the locking portions can be received, thereby allowing the retention device to be readily inserted in the locking portions.

Preferably, the shaped elements are formed by prongs of a fork-like structure which is defined by the plate. In this manner, it is possible to surround a plurality of locking portions with a single structure.

In one embodiment, the shaped elements comprise a planar abutment surface which is configured in such a manner that the planar surface of the locking portions abuts it when the locking portions are inserted in the blocking recesses. Preferably, the distance between diametrically opposed planar surfaces of the blocking surface is equal to the distance between two shaped elements. This allows the formation of a form-fitting connection with respect to the locking portions which can readily be used and connected.

According to yet another aspect, the invention also relates to a kit comprising a screening bucket and a retention device which are constructed according to one or more of the characteristics mentioned above.

Preferably, the kit comprises fixing means of the retention device on the screening bucket which are configured so as to be able to fix the retention device in a non-operating position, in which the rotatable supports are free to rotate, and an operating position, in which the locking portions are retained by the retention device, blocking the rotation of the rotatable supports.

According to a preferred embodiment, the fixing means comprise a pin and two respective holes. The pin can be inserted in a respective hole of the two holes in order to be arranged in the non-operating position and in the operating position, respectively. This characteristic allows the retention device to be received and used in a simple manner on the bucket.

Preferably, the receiving seat is formed on the rotatable support and has an inlet opening for inserting the coupling extension, the locking portions and the shaped elements being configured so that, when the retention device blocks the rotation of the rotatable supports, the inlet opening faces towards the outer side of the receiving member through the discharge opening. In this manner, the receiving seats remain orientated, when the retention device is in an operating position, in the direction which is more favourable for the insertion of the rotating elements.

Other advantages, characteristics and the methods of use of the present invention will be appreciated more clearly from the following detailed description of some embodiments, which are set out by way of non-limiting example. Reference will be made to the Figures of the appended drawings, in which:

FIG. 1 is a perspective view of a screening bucket according to the present invention;

FIGS. 2A to 2C are perspective views, two of which are detailed views, of a positioning sequence in an operating position of the retention device for the rotatable supports of the screening bucket according to the present invention;

Figure 2B:
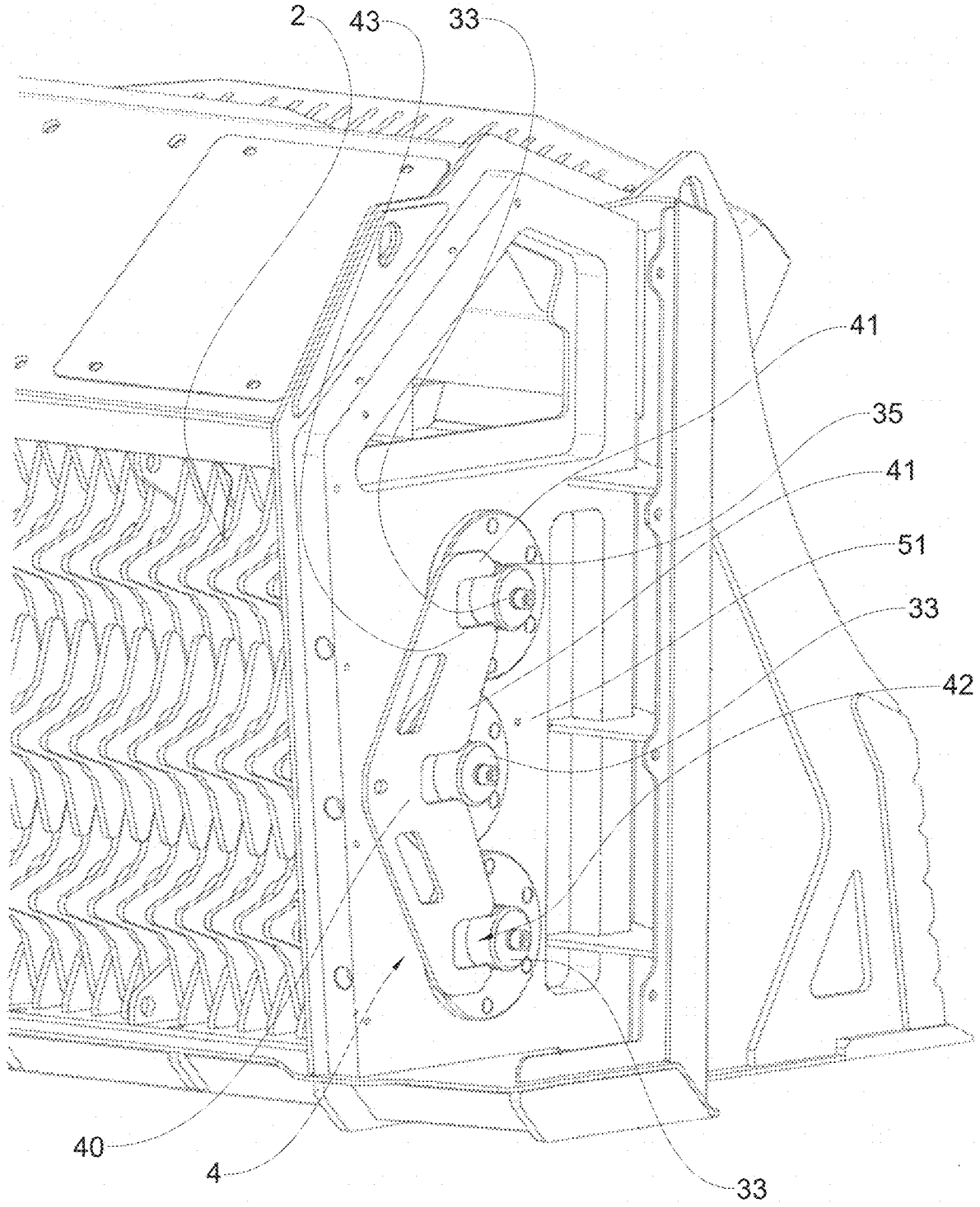

With reference initially to FIG. 1, there is generally designated with reference number 100 a screening bucket according to the present invention.

The screening bucket 100 comprises a main structure 1 in which there is defined to a collecting portion 10, which is preferably of blade-like form and by which the material to be screened can be collected. The collecting portion 10 is connected to a receiving member 11, in which there is collected the material to be subjected to screening.

There is defined in the receiving member a discharge opening 12 for the screened material, which is partially obstructed by a plurality of elements 2 which rotate about a rotation axis X. The rotating elements 2 are arranged in a mutually parallel manner and substantially define a base wall of the receiving member, in the region of the discharge opening 12.

According to a preferred embodiment, the rotating elements 2 have a plurality of radial extensions 20, for example, of star-like form. In this manner, the extensions can form teeth which, by the rotation of the rotating elements, act on the material, obtaining the desired screening thereof.

Preferably, the radial extensions 20 are of planar form and are spaced apart from each other along the rotation axis X.

In one embodiment, the radial extensions 20 of a rotating element 2 are axially staggered with respect to the radial extensions of the adjacent rotating elements. In this manner, the trajectories of the radial extensions 20 of two rotating elements 2 can pass through each other.

Therefore, these configurations allow the definition of restricted passages between two adjacent rotating elements, thereby allowing the passage through the discharge opening 12 only of material below a predetermined dimension during the rotation of the rotating elements 2.

It is evident that the specific configuration of the rotating elements will be defined by the type of material which has to be screened and the degree of screening required.

In order to provide for different processing operations, the rotating elements can also be removed and, to this end, are supported in a removable manner on pairs of opposing bearing groups 3.

In particular, each rotating element 2 is supported in the region of an end by a first bearing group 3A which is only partially visible in the Figures and which is connected to a transmission which produces the rotation thereof.

Figure 7:
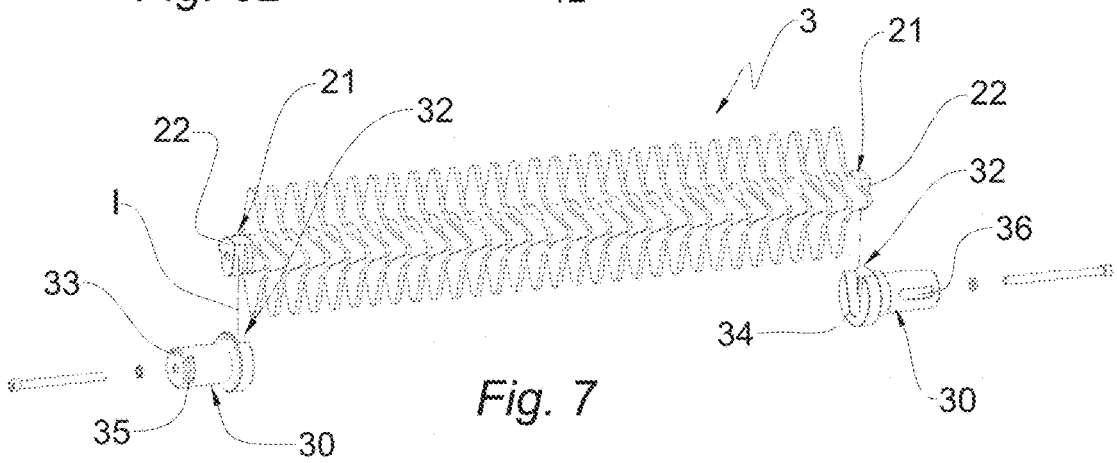
FIG. 7 is a partially exploded, perspective view of a rotating element and a relevant rotatable support, a detail of the bucket according to the present invention.

The transmission, which is not illustrated in the Figures, may be, for example, produced by a system involving a chain and toothed wheels, the wheels being keyed to a relevant rotatable support 30 of the bearing group by a key seat 36 which is illustrated in FIG. 7.

The opposite end is supported by a second bearing group 3B which is movable instead, that is to say, it is caused to rotate by the rotating element 2 itself.

With reference again to FIG. 1, in a preferred embodiment the bearing groups 3 comprise a bearing 31 and a rotatable support 30, on which an end 21 of the rotating element 2 is connected. The rotatable support 30 is connected to the bearing 21 in the region of the rotating portion thereof, preferably in the region of the internal ring thereof. In one embodiment, the rotatable support 30 is keyed by interference to the rotating portion of the bearing.

According to another aspect of the invention, the rotatable support has a portion which projects axially towards the discharge opening 12 with respect to the bearing on which it is mounted, that is to say, towards the zone in which the rotating elements 2 are received. It may be understood that in the context of the present invention the axial direction is identified by the rotation axis of the bearing and the rotating element, unless otherwise specified.

The Figures show only the housing of the bearing 31, the internal portions thereof not being illustrated, which allows the assembly thereof on the receiving member 11, preferably in the region of a lateral wall 13 thereof.

As can better be seen in FIG. 7, according to a preferred embodiment the rotating element 3 is preferably connected to the two bearing groups by a male/female connection which is formed by a receiving seat 32 and by a coupling extension 22.

According to a preferred embodiment, the receiving seat 32 is formed on the rotatable support 30, preferably in the projecting portion towards the opening 12, while the coupling extension 22 is formed on the rotating element 2. It is evident that there could also be provision for a transposed embodiment, that is to say, in which the male element is formed on the bearing group while the female element is formed on the rotating element.

Figure 4:
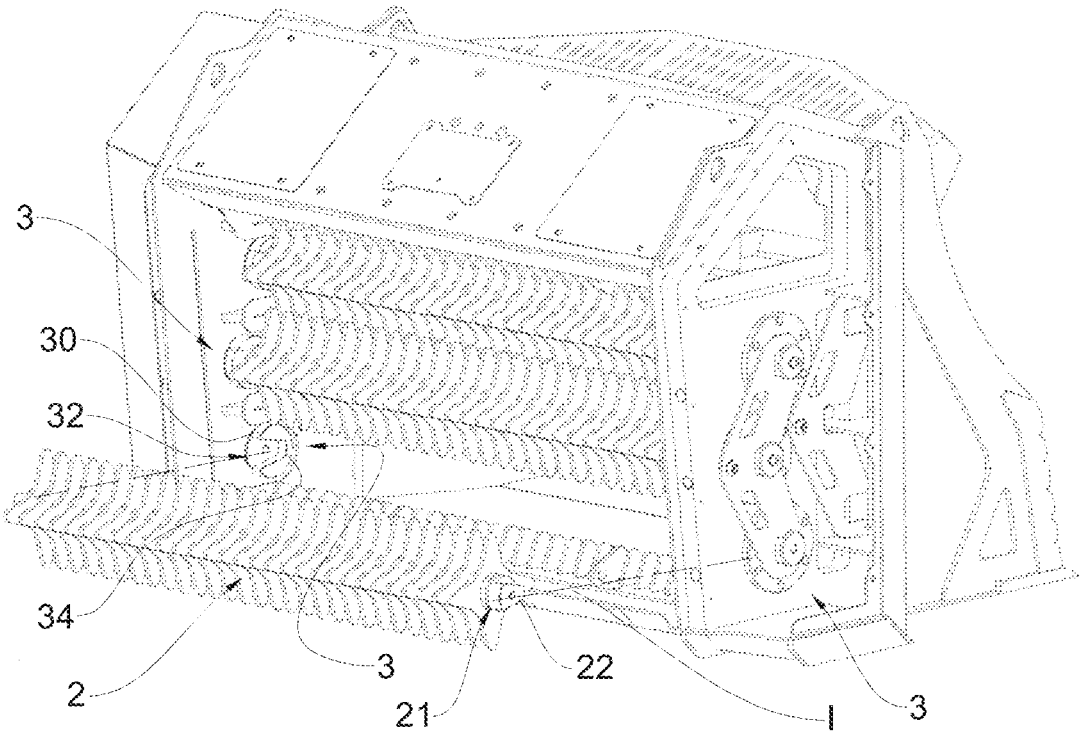
FIGS. 4, 5 and 5A are two views, a perspective view and a relevant detailed view, of the screening bucket of the present invention with a rotating element removed.
Figure 5:
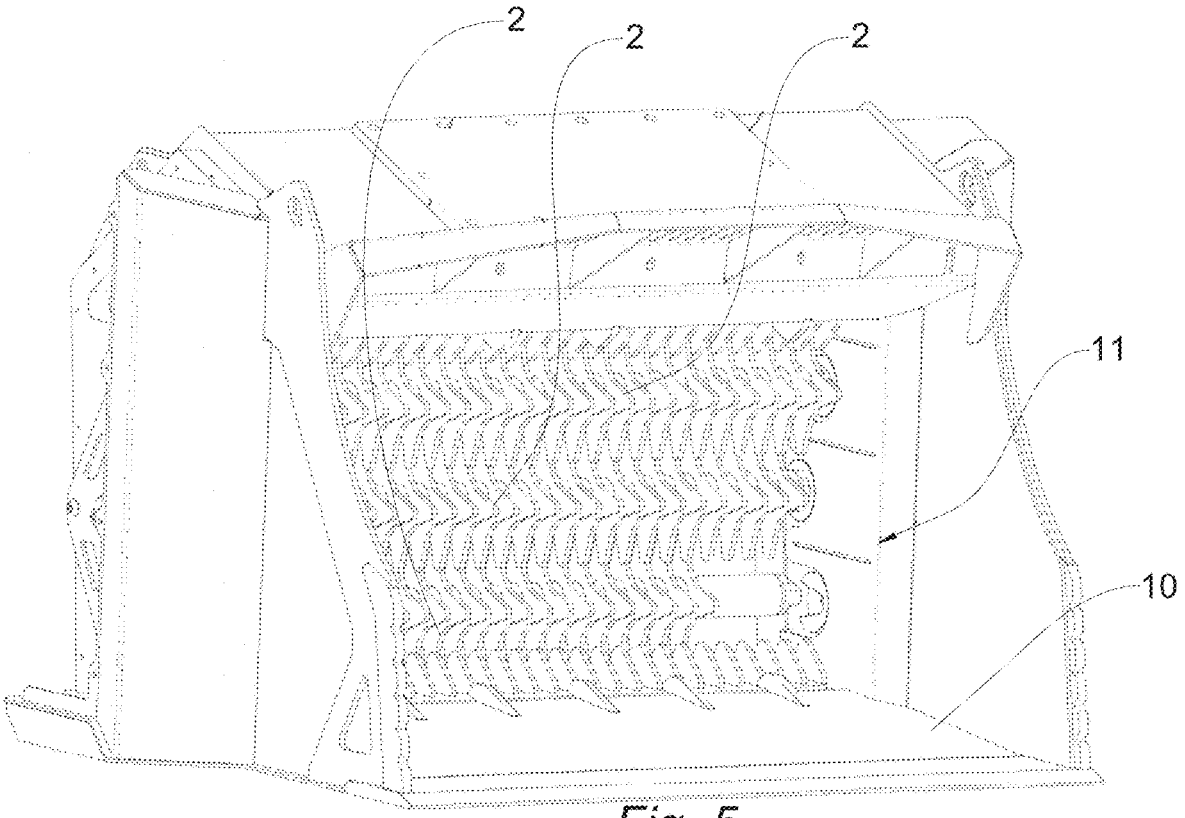
Figure 5A:
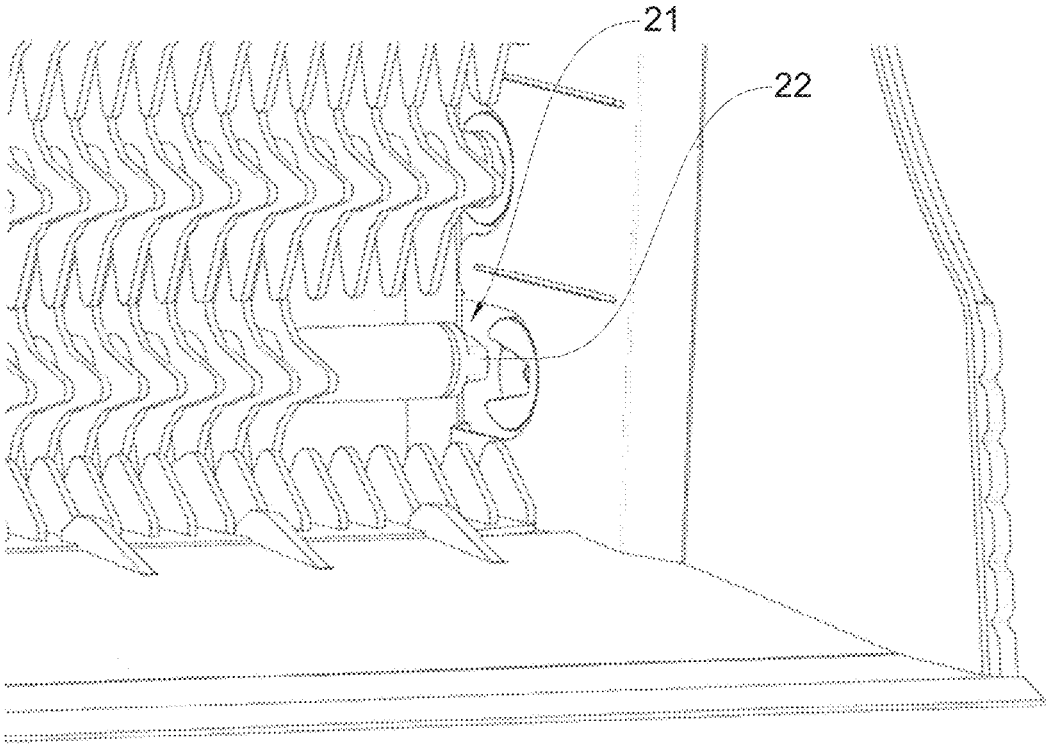

As can be observed in the Figures, in particular in FIGS. 4 and 6, the above-described connection is configured so that the rotating element 2 can be removably connected to the bearing groups 3, by being moved towards/away from the bearing groups in an insertion direction I, which is advantageously orientated transversely with respect to the rotation axis X of the rotating element 2. It may be noted that in the context of the present invention the term transverse indicates that the insertion direction I crosses the rotation axis X in a perpendicular or oblique manner and, in other words, the two directions are not parallel with each other.

In fact, the receiving seat and the coupling extension are configured in such a manner that the coupling extension can be inserted/withdrawn in/from the receiving seat by a reciprocal approaching/withdrawal movement in a transverse direction with respect to the rotation axis of the rotating element.

Preferably, the receiving seat 32 is in the form of a V-like undercut which is formed on an internal face, which is perpendicular to the rotation axis X, of the rotatable support 30.

More generally, the seat 32 may advantageously have a base wall 34 which optionally in the above-mentioned embodiment corresponds to the base of the V, which is configured so as to abut the coupling extension 22 when it is inserted in the receiving seat 32.

In this manner, the base wall 34 may act as a limit stop, by blocking the advance of the coupling extension 22, and therefore of the rotating element 2, in the insertion direction I. In this manner, the coaxiality between the rotating element 2 and rotatable support 30 can be ensured.

Still in order to ensure the coaxiality but also in order to make the connection between the two portions simpler, the receiving seat 32 and the shaped portion 21 may have a tapered shape. Preferably, the receiving seat 32 narrows progressively from a relevant opening thereof in the insertion direction and therefore towards the base wall if present.

In other words, the receiving seat is therefore narrowed in the insertion direction I.

Again with reference to FIG. 1, the bucket according to the present invention further comprises a locking portion 33, which is preferably arranged in the region of the rotatable support 30 and which is capable of being retained by a corresponding retention device 4 so as to prevent the rotation of the rotatable support 30.

In this manner, when the rotating elements 2 are removed from the bucket, the bearing groups 3 are not subjected to any rotation.

Therefore, this allows the replacement or the maintenance of the rotating elements 2 to be carried out by maintaining the rotating members in a fixed position and therefore allows the rotating elements to be received again in the same position in which they were located before the maintenance operation. This characteristic is found to be particularly advantageous for the second bearing groups 3B which, being movable, could readily rotate when the rotating elements 2 are removed.

Therefore, in one embodiment the retention device 4 is used only in the region of these bearing groups, the others being kept locked by the transmission.

With particular reference now to FIG. 2B, the retention device 4 is preferably formed by a plate and comprises a plurality of shaped elements 41 which are configured so as to be able to be connected to the locking portions 33 so as to prevent the rotation of the rotatable supports 30.

In one embodiment, the connection between the retention device 4 and locking portions 33 is produced by abutment between respective planar surfaces 35 and 43.

To this end, the locking portions 33 may comprise a planar surface 35 and even more preferably a pair of diametrically opposed planar surfaces 35. These surfaces can, for example, be constructed by two lateral notches which are constructed on the locking portion 33 of the rotatable support 30.

The two planar surfaces 35 are therefore locked in a fork-like manner between two adjacent shaped elements 41 which therefore define locking recesses 42 inside which the locking portions 33 can be received.

In other words, the shaped elements 41 are formed by prongs of a fork-like structure defined by the plate 40.

Preferably, the shaped elements 41 comprise a planar abutment surface 43 which is configured in such a manner that the planar surface 35 of the locking portions 33 abuts it when the locking portions 33 are inserted in the locking recesses 42.

Figure 2C:
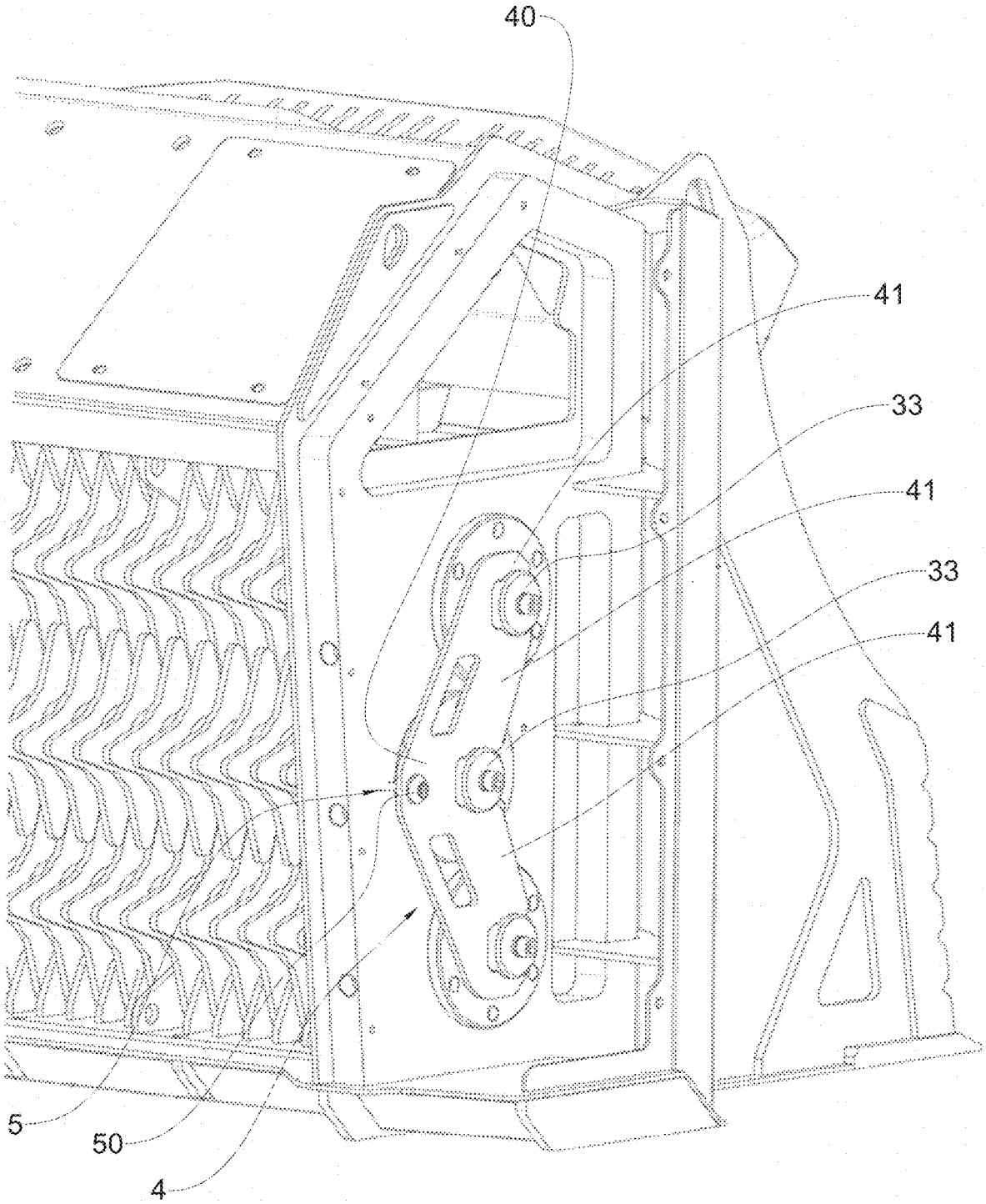

The sequence of the positioning steps of the retention device 4 is illustrated in FIGS. 2A to 2C.

It may be noted that in one embodiment, in order to make the locking portions 33 more accessible, they project from the lateral walls 13 in an opposite direction along the X axis with respect to the rotating elements 2, thereby making the planar walls 35 readily accessible.

Figure 6A:
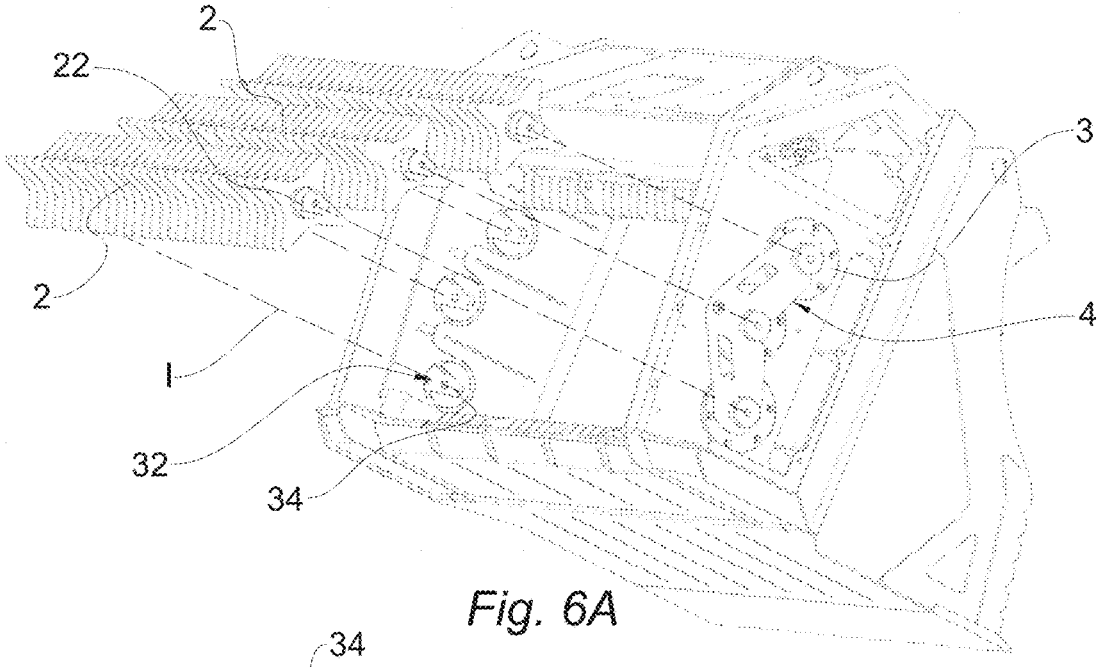
FIGS. 6A and 6B are two perspective views according to different points of view of the screening bucket of the present invention with the rotating elements removed.
Figure 6B:
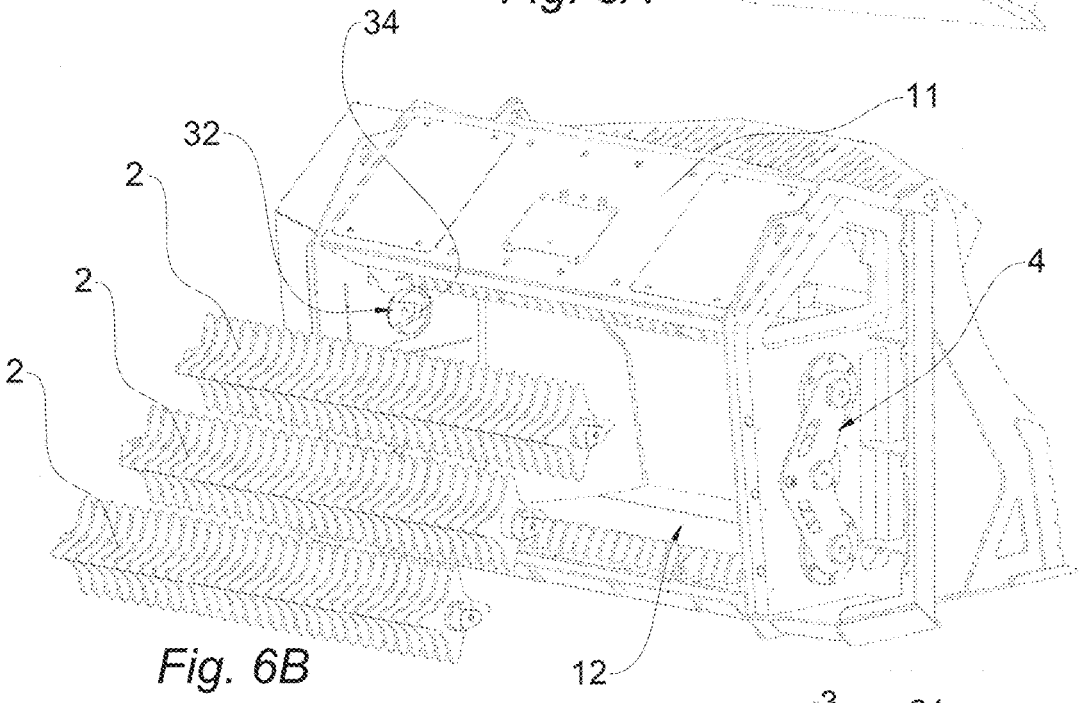

FIGS. 6A and 6B instead illustrate the bucket according to the present invention when the retention device 4 is in an operating position, that is to say, when it blocks the rotation of the rotating elements.

As can be seen in the Figures, according to a preferred embodiment the locking portions 33 and the shaped elements 41 are configured in such a manner that, when the retention device 4 blocks the rotation of the rotatable supports 30, the inlet opening faces towards the outer side of the receiving member 11 through the discharge opening 12.

This advantageously allows maintenance of the rotatable supports in the most favourable position in order to insert and remove the rotating elements.

With reference again to FIGS. 1 and 2A, the present invention can be advantageously supplied in the form of a kit, with the retention device 4 being supplied together with the screening bucket 100.

Figure 3:
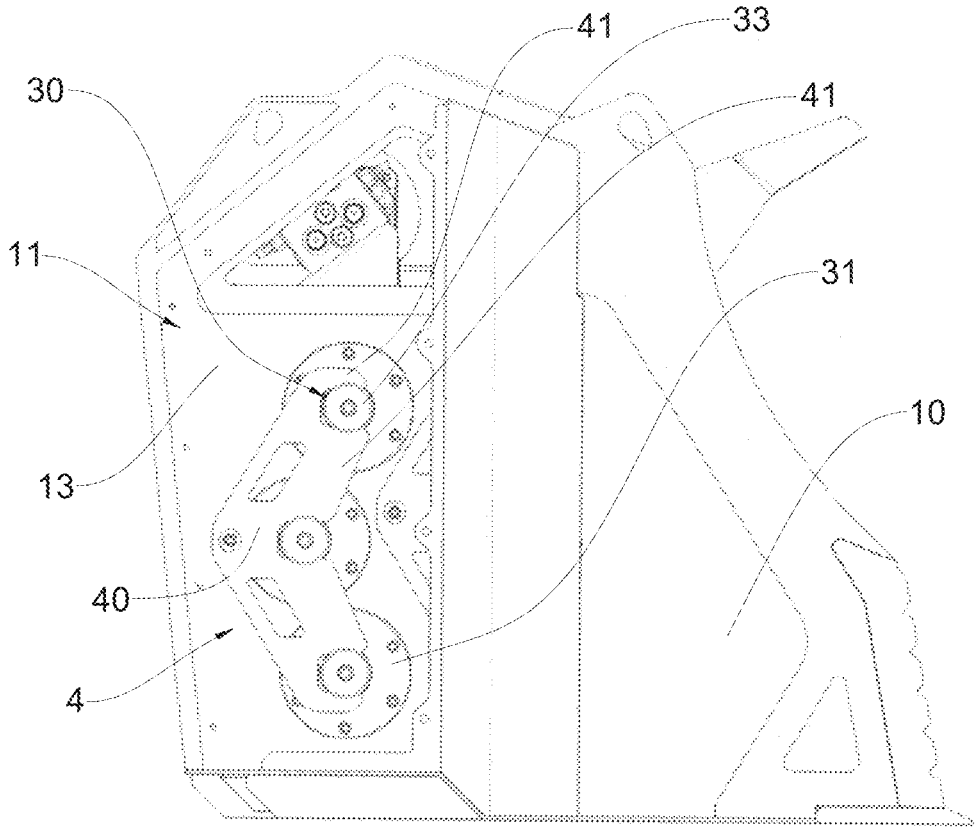
FIG. 3 is a side view of the screening bucket with the retention device in an operating position.

Preferably, in this case there are present fixing means 5 of the retention device 4 on the screening bucket 100, which are configured so as to be able to fix the retention device 4 in the non-operating position which is illustrated in FIG. 1 and in which the rotatable supports 30 are free to rotate, and in the operating position which is illustrated, for example, in FIGS. 3 and 4 and in which the locking portions 33 are retained by the retention device 4, blocking the rotation of the rotatable supports 30.

According to a preferred embodiment, the fixing means 5 comprise a pin 50 and two respective holes 51, 52. The pin 50, which may be a threaded pin or also a screw, can be inserted in one of the two holes in order to be arranged in the non-operating position and in the operating position, respectively.

The invention thereby solves the problem set, at the same time achieving a plurality of advantages, including a substantial simplification of the assembly and disassembly operations of the rotating elements with substantial benefits during the assembly and maintenance steps of the bucket.

The invention claimed is:

1. A screening bucket (100) comprising a main structure (1) comprising a collecting portion (10) for the material to be screened and a receiving member (11) in which the material which is subjected to sieving is collected and which has a discharge opening (12) for the screened material, a plurality of rotating elements (2) which are arranged in the region of the discharge opening (12) so as to at least partially obstruct the discharge opening (12), allowing the passage of material having dimensions less than a predetermined dimension when the rotating elements (2) are rotated, the rotating elements (2) being supported in a removable manner on pairs of opposing bearing groups (3), the bearing groups comprising a bearing (31) and a rotatable support (30), which is fixed to the bearing (31) and to which an end (21) of the rotating element (2) is connected by a male/female connection which is formed by a receiving seat (32) and by a coupling extension (22) formed on the rotatable support (30) and on the rotating element (2), respectively, or vice-versa, the receiving seat (32) and the coupling extension (22) being configured so that the coupling extension (22) can be inserted in/withdrawn from the receiving seat (32) by a reciprocal movement towards/away in a transverse insertion direction (I) with respect to a rotation axis (X) of the respective rotation element (2), the rotatable support (30) further comprising a locking portion (33) retainable by a corresponding retention device (4) so as to prevent rotation of the rotatable support (30) when the rotating element (2) is removed.

2. The screening bucket (100) according to claim 1, wherein the receiving seat (32) comprises a base wall (34) which is configured so as to abut the coupling extension (22) when the coupling extension is inserted in the receiving seat (32), blocking the advance thereof in the insertion direction (I).

3. The screening bucket (100) according to claim 1, wherein at least one of the receiving seat (32) or the coupling extension (22) have a tapered shape.

4. The screening bucket (100) according to claim 3, wherein the receiving seat (32) progressively narrows from a respective opening thereof in the insertion direction (I).

5. The screening bucket (100) according to claim 3, wherein the receiving seat (32) is in the form of a V-shaped undercut formed on an internal face, which is perpendicular to the rotation axis (X), of the rotatable support (30).

6. The screening bucket (100) according to claim 1 wherein the locking portions (33) comprise a planar surface (35).

7. The screening bucket (100) according to claim 1 wherein each rotating element (2) is supported in the region of an end by a first bearing group (3A) which is connected to a transmission which produces the rotation thereof and in the region of an opposite end by a second movable bearing group (3B), the locking portions (33) being formed only in the region of the second movable bearing group (3B).

8. The screening bucket (100) according to claim 1 wherein the receiving seat (32) or said coupling extension (22) is/are formed in the region of a portion of the rotatable support (30) which axially projects towards the discharge opening (12).

9. The screening bucket (100) according to claim 1 wherein the receiving member (11) comprises a pair of lateral walls (13), each of which supports a respective bearing group (3).

10. The screening bucket (100) according to claim 9, wherein the locking portions (33) project from the lateral wall (13) of the respective bearing group (3) in the opposite direction with respect to the rotating elements (2).

11. The screening bucket (100) according to claim 8, wherein the locking portions (33) and the portions of the rotatable support (30) in which the receiving seat (32) or the coupling extension (22) are formed, project from the lateral wall (13), some in the opposite direction to the others.

12. A retention device (4) for rotatable supports (30) of the screening bucket (100) according to claim 1 comprising a plurality of shaped elements (41) which are configured so as to be able to be connected to the locking portions (33) so as to prevent the rotation of the rotatable supports (30).

13. The retention device (4) according to claim 12, wherein blocking recesses (42) are defined between adjacent shaped elements (41) inside which the locking portions (33) can be received.

14. The retention device (4) according to claim 13, wherein the shaped elements (41) are formed by prongs of a fork-shaped structure which is defined by a plate (40).

15. The retention device (4) according to claim 13, wherein the shaped elements (41) comprise a planar abutment surface which is configured such that the planar surface (35) of the locking portions (33) abuts the planar abutment surface when the locking portions (33) are inserted in the blocking recesses (42).

16. The retention device (4) according to claim 12, wherein the distance between diametrically opposed planar surfaces (35) of the blocking surface (33) is equal to the distance between two shaped elements (41).

17. A kit comprising a screening bucket (100) according to claim 1 and a retention device (4) comprising a plurality of shaped elements (41) which are configured so as to be able to be connected to the locking portions (33) so as to prevent the rotation of the rotatable supports (30).

18. The kit according to claim 17, further comprising fixing means (5) of the retention device (4) on the screening bucket (100) which are configured so as to be able to fix the retention device (4) in a non-operating position, in which the rotatable supports (30) are free to rotate, and an operating position, in which the locking portions (33) are retained by the retention device (4), blocking the rotation of the rotatable supports (30).

19. The kit according to claim 18, wherein the fixing means (5) comprise a pin and two respective holes, the pin being able to be inserted in a respective hole of the two holes in order to be arranged in the non-operating and in the operating position, respectively.

20. The kit according to claim 17, wherein the receiving seat (32) is formed on the rotatable support (30) and has an inlet opening for inserting the coupling extension (22), the locking portions (33) and the shaped elements (41) being configured so that, when the retention device (4) blocks the rotation of the rotatable supports (30), the inlet opening faces towards the outer side of the receiving member (11) through the discharge opening (12).

* * * * *